US005178693A

United States Patent [19]

Miyakusu et al.

[11] Patent Number: 5,178,693

[45] Date of Patent: Jan. 12, 1993

[54] PROCESS FOR PRODUCING HIGH STRENGTH STAINLESS STEEL OF DUPLEX STRUCTURE HAVING EXCELLENT SPRING LIMIT VALUE

[75] Inventors: Katsuhisa Miyakusu, Shinnanyo; Teruo Tanaka, Kure; Hiroshi Fujimoto, Tokuyama; Chizui Toyokihara, Shinnanyo, all of Japan

[73] Assignee: Nisshin Steel Co., Ltd., Tokyo, Japan

[21] Appl. No.: 651,250

[22] PCT Filed: Jul. 19, 1990

[86] PCT No.: PCT/US90/00930

§ 371 Date: Mar. 15, 1991

§ 102(e) Date: Mar. 15, 1991

[87] PCT Pub. No.: WO91/01385

PCT Pub. Date: Feb. 7, 1991

[30] Foreign Application Priority Data

Jul. 22, 1989 [JP] Japan ..... 1-190274

[51] Int. Cl.[5] ..... C21D 8/02; C21D 9/02; C21D 9/46

[52] U.S. Cl. ..... 148/580; 148/605; 148/607; 148/608; 148/622; 148/326; 148/328

[58] Field of Search ..... 148/12 E, 12 EA, 12.3, 148/12.7 R, 326, 328, 579, 580, 605, 607, 608, 622

[56] References Cited

U.S. PATENT DOCUMENTS 4,812,176 3/1989 Tanaka et al. ..... 148/12 EA
5,019,181 5/1991 Yazawa et al. ..... 148/12.3

*Primary Examiner*—R. Dean
*Assistant Examiner*—Sikyin Ip
*Attorney, Agent, or Firm*—Lowe, Price, LeBlanc & Becker

[57] ABSTRACT

A process for the production of a stainless steel strip having excellent spring characteristics as such and good formability, wherein a cold rolled strip of a stainless steel comprising, in addition to Fe, from 10.0 to 20.0% by weight of Cr, from 0.01 to 0.15% by weight of C, and at least one of Ni, Mn and Cu in an amount of from 0.1 to 4.0% by weight, is continuously passed through a continuous heat treatment furnace where it is heated to a temperature range for a two-phase of ferrite and austenite, rapidly cooled to provide a strip of a duplex structure, consisting essentially of ferrite and martensite, optionally temper rolled at a rolling reduction of not more than 10%, and continuously passed through a continuous heat treatment furnace to effect aging of not longer than 10 minutes.

5 Claims, 2 Drawing Sheets

PROCESS FOR PRODUCING HIGH STRENGTH STAINLESS STEEL OF DUPLEX STRUCTURE HAVING EXCELLENT SPRING LIMIT VALUE

FIELD OF THE INVENTION

The present invention relates to a commercial process for the production of a high strength stainless steel strip of a duplex structure essentially consisting of ferrite and martensite, which has an excellent spring limit value. The product of the process according to the invention is a novel stainless steel strip which is mainly suitable for use in the production of springs such as thin plate spring and windup spring. The product is commercially produced in the form of a strip, and is delivered to a market in the form of a strip as produced (a coiled strip) or in the form of plates cut therefrom. Since these strip and plates already have necessary spring characteristics for end use, springs formed therefrom need no special heat treatment.

BACKGROUND OF THE INVENTION

Japanese Industrial Standards JIS G 4313 standardizes 4 types of stainless steel strips for spring. They are austenitic SUS301-CSP, austenitic SUS304-CSP, martensitic SUS420J2-CSP and precipitation hardenable SUS631-CSP.

The austenitic stainless steel strips, SUS301-CSP and SUS304-CSP, are to be work hardened by cold rolling to increase strength, and depending upon the degree of the temper rolling (% rolling reduction) there are standardized 4 species of SUS301-CSP and three species of SUS304-CSP. Such austenitic stainless steel strips for spring are delivered in the cold rolled condition from a steel maker to a spring maker, where they are formed into desired shapes of springs, and thereafter when further enhancement of spring characteristics are desired they are subjected to aging of the order of 400° C., 1 hour The martensitic stainless steel strips, SUS420J2-CSP, are to be quenched and tempered to increase hardness (strength) thereby achieving spring characteristics. In many cases, such martensitic stainless steel for spring are delivered in the cold rolled and annealed condition from a steel maker to a spring maker, where they are formed into desired shapes of springs, and thereafter subjected to quenching and tempering treatment.

The precipitation hardenable stainless steel strips, SUS631-CSP, except for those of SUS631-CSP-0 which are delivered from a steel maker in the solution treated condition, are delivered in the cold rolled condition from a steel maker to a spring maker, as is the case with the austenitic strips, and by the spring maker they are formed into desired shapes of springs, and thereafter subjected to precipitation hardening to enhance spring characteristics. Incidentally, various precipitation hardenable stainless steel strips for spring, other than SUS631-CSP according to JIS, are commercially available.

Problems the Invention Aims to Solve

With the austenitic and precipitation hardenable stainless steels for spring, as the temper rolling reduction is increased the hardness and spring limit value are improved. Furthermore, the higher the % temper rolling reduction, the higher the hardness and spring limit value attainable after the aging or precipitation hardening.

Accordingly, in order to enhance the spring characteristics it is necessary to use an increased % temper rolling reduction. The increase in the spring limit value by cold rolling is, however, greater in the direction of rolling (LD) of the strip than in the direction perpendicular thereto (TD), and there is posed a problem of anisotropy in that the difference in the spring limit value between both the directions is intolerably increased as the % temper rolling reduction is increased, frequently limiting the direction in which springs are taken from the strip.

Moreover, in cases wherein ultrathin plates of a thickness of not in excess of 0.3 mm having a high spring limit value are required, it is necessary to prepare such ultrathin plates with a very high rolling reduction. It is not technically easy, however, to prepare broad and ultrathin steel strips of a good shape by cold rolling with highly work-hardenable materials as SUS301-CSP, SUS304-CSP or SUS631-CSP.

With the martensitic stainless steel strips for spring there are problems in that the corrosion resistance is not fully satisfactory because of the low Cr content ranging from 12.00 to 14.00% and that the processability is not satisfactory because of the low proof strength owing to the high C content ranging from 0.26 to 0.40%.

In addition to the problems discussed above, the most serious problem common to the known stainless steel strips for spring is resides in the fact that in order to achieve desirably enhanced spring characteristics, products mechanically formed from the known stainless steel strips into desired shapes of the final springs have to be subjected to heat treatment at the spring maker side, aging in the case of the austenitic strips, quenching and tempering in the case of the martensitic strips and precipitation hardening in the case of the precipitation hardenable strips. Such batchwise heat treatment of the products formed into desired shapes of the final springs inevitably increases the manufacturing costs.

It has heretofore been considered essential to carry out the above-mentioned heat treatment of the products formed into desired shapes of the final springs for enhancement of the spring characteristics except for certain cases wherein certain austenitic stainless steel strips are used and wherein particularly high spring characteristics are not required. If the heat treatment is carried out before the strip is mechanically formed into shapes of the springs, there results in an unduly strong and hard strip which is hard to be mechanically formed or punched out into desired shapes of the springs, and such is not normally carried out.

SUMMARY OF THE INVENTION

The problems discussed above could be solved at once, if it is possible to stably produce a stainless steel strip, including an ultrathin one, which has a good formability that is a property capable of being mechanically formed into products of desired shapes of springs, said products as formed having excellent spring characteristics without the need of any additional heat treatment, said spring characteristics (spring limit value) being fairly plane isotropic. The solution to the problems according to the invention resides in a process for the production of a high strength stainless steel strip of a duplex structure having an excellent spring limit value, which comprises:

conventional hot rolling and cold rolling steps to provide a cold rolled strip of a stainless steel comprising, as essential ingredients, in addition to Fe, from 10.0 to 20.0% by weight of Cr, from 0.01 to 0.15% by weight of C, and at least one of Ni, Mn and Cu in an amount of from 0.1 to 4.0% by weight;

a step of heat treatment for forming a duplex structure in which the cold rolled strip is continuously passed through a continuous heat treatment furnace where it is heated to a temperature range for a two-phase of ferrite and austenite, and thereafter the heated strip is rapidly cooled to provide a strip of a duplex structure, consisting essentially of ferrite and martensite;

an optional step of temper rolling the strip of the duplex structure at a rolling reduction of not more than 10%; and a step of continuous aging of not longer than 10 minutes in which the strip of the duplex structure is continuously passed through a continuous heat treatment furnace.

DETAILED DESCRIPTION OF THE INVENTION

Some of us proposed processes for the production of a high elongation and strength strip or sheet of a chromium stainless steel of a duplex structure, consisting essentially of ferrite and martensite, having reduced plane anisotropy on strength and elongation wherein a cold rolled strip or sheet of a chromium stainless steel in which alloying elements are appropriately controlled and which is prepared by conventional hot rolling, annealing and cold rolling, is subjected to, instead of conventional finish annealing at a temperature for a single phase of ferrite, finish heat treatment comprising heating to a temperature range for a two phase of ferrite and austenite and rapid cooling (JP A 63-7338, JP A 63-169330, JP A 63-169331, JP A 63-169332, JP A 63-169333, JP A 63-169334 and JP A 63-169335). On the high strength stainless steel strips of a duplex structure we have further conducted investigation and research works and found a measure which can solve substantially all of the above-discussed problems associated with prior art stainless steel strips for spring.

The invention will now be described by typical experimental results.

Each molten steel of Steel species A, B and C having chemical compositions as indicated in Table 1 was prepared, made to a hot rolled strip having a thickness of 3.6 mm, annealed in an furnace at a temperature of 780° C. for a soaking time of 6 hours, allowed to cool in the furnace, pickled, cold rolled to a thickness of 1.0 mm, subjected to intermediate annealing at 800° C. for a soaking time of 1 minute, cold rolled to a strip of 0.3 mm in thickness, and subjected to continuous heat treatment for forming a duplex structure consisting essentially of ferrite and martensite. The heat treatment comprised of heating at 950° C. for 1 minute followed by rapid cooling. The heat treatment for forming a duplex structure of ferrite and martensite will be referred to herein briefly as heat treatment

TABLE 1

| Steel | C | Si | Mn | P | S | Ni | Cr | N | Cu |
|---|---|---|---|---|---|---|---|---|---|
| A | 0.0470 | 0.42 | 0.29 | 0.019 | 0.009 | 1.04 | 16.18 | 0.0140 | 0.02 |
| B | 0.0513 | 0.56 | 0.35 | 0.021 | 0.001 | 2.01 | 16.44 | 0.0074 | 0.05 |
| C | 0.0507 | 0.57 | 0.34 | 0.020 | 0.001 | 3.01 | 16.46 | 0.0063 | 0.01 |

From each stainless steel strip of a duplex structure so prepared, samples were taken and tested for the hardness and spring limit value Kb. Further, the samples were aged under conditions indicated below, and tested for the hardness and spring limit value Kb. The spring limit value Kb used herein as a measure of spring characteristics is generally defined as the maximum surface stress causing a permanent deformation equivalent to an elastic deformation caused by the maximum surface bending stress of $0.375 \times E/10^4$ (kgf/mm$^2$), which was determined by repeated deflection tests in accordance with JIS H 3130.

Figure 1:
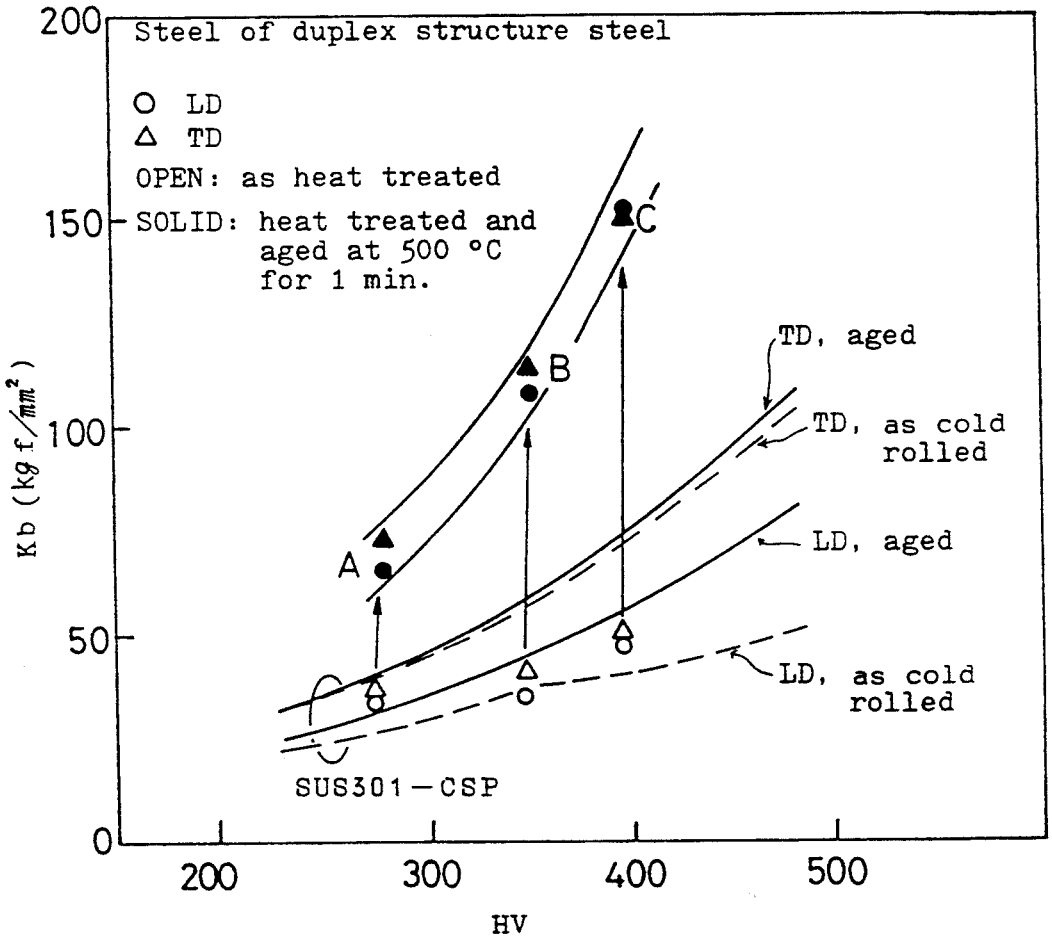
FIG. 1 is graphical showings of the relationship between the hardness and the spring limit value Kb on high strength stainless steels of a duplex structure according to the invention in comparison with that on commercially available austenitic stainless steels for spring SUS301 CSP.

FIG. 1 depicts the relationship between the spring limit value Kb in LD (rolling direction) and TD (perpendicular to rolling direction) and the surface hardness (HD) on Steels A, B and C in both the (1) as heat treated (for forming a duplex structure) and (2) heat treated and aged (at 500° C. for 1 minute) conditions. For comparison purposes, on a commercially available austenitic stainless steel strip, SUS301-CSP, levels of the spring limit value Kb before and after aging of one hour at 400° C. are shown in the same figure by broken lines (as cold rolled before aging) and solid lines (after aging), respectively.

FIG. 1 reveals that the duplex structure steels in the as heat treated condition (before aging) have a spring limit value Kb of about from 30 to about 50 kgf/mm$^2$ which is approximately the same as that of SUS301-CSP in LD; when such duplex steels are subjected to short time aging of 1 minute at 500° C., while the hardness undergoes slight increase (substantially no change in the hardness), the spring limit value Kb is drastically enhanced; and when compared on the same hardness level, the duplex structure steels in the heat treated and aged condition exhibit a spring limit value Kb at least twice that of the aged SUS301-CSP, indicating excellent spring characteristics of the products obtainable by the process according to the invention. It is further revealed from FIG. 1 that the difference in Kb between LD and TD of the duplex structure steels is at most about 10 kgf/mm$^2$ which is much smaller than that of SUS301 CSP, indicating reduced plane anisotropy of Kb with the duplex structure steels.

Incidentally, with the duplex structure steels, as is the case with the austenitic and precipitation hardenable stainless steel strips, the higher the hardness the higher the spring limit value, and the higher the hardness the greater the increase of Kb by aging.

Figure 2:
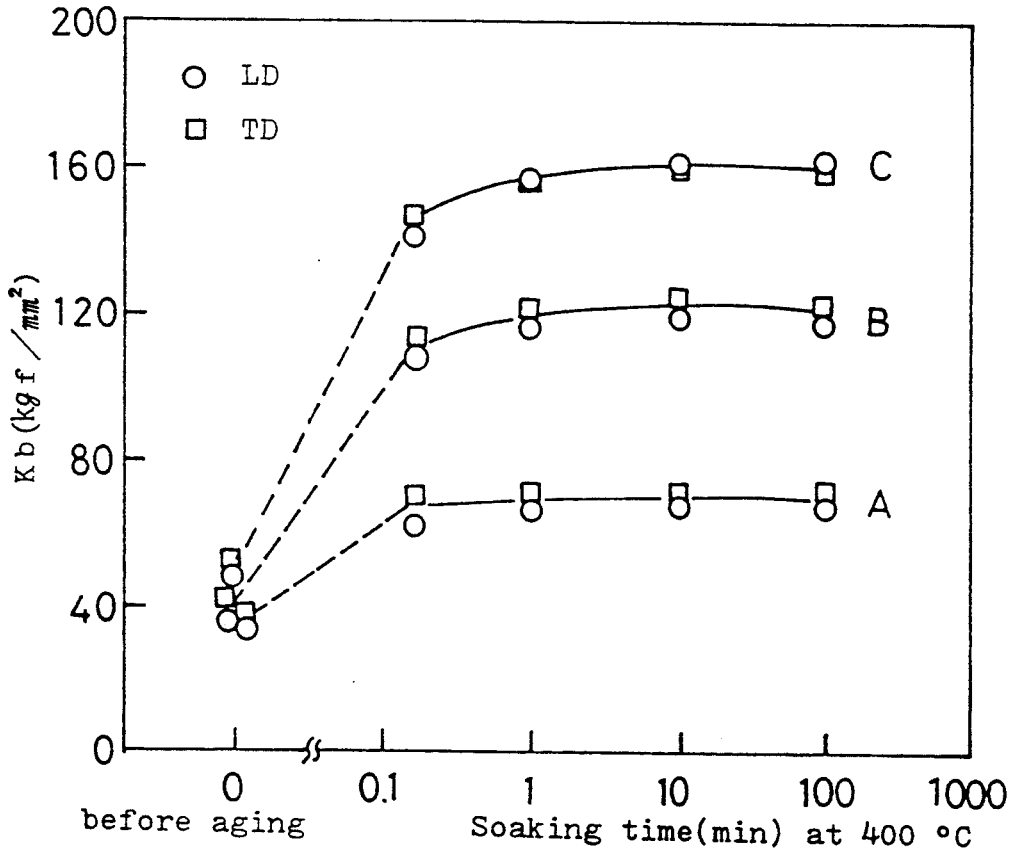
FIG. 2 is graphical showings of the spring limit value plotted against the aging time on high strength stainless steels of a duplex structure according to the invention.

Samples were taken from the duplex structure strips as heat treated having a thickness of 0.3 mm, aged at a temperature of 400° C. for varied soaking times, and tested for the spring limit value Kb. FIG. 2 shows the influence of the soaking time on the spring limit value Kb.

FIG. 2 reveals that with each steel the spring limit value Kb drastically increases within a short period of time, becomes almost saturated after about one minute and exhibits no substantial increase after about 10 minutes.

The results shown in FIGS. 1 and 2 are very interesting and indicate the following practical advantages of the process according to the invention.

(1). By aging a duplex structure steel a much higher spring limit value can be achieved than that attainable with a conventional austenitic stainless steel strip on the same strength basis. In other words, to achieve the same level of spring characteristics as attainable with a conventional material for spring, a duplex structure steel having a much lower strength (hardness) is sufficient, indicating advantages with respect to the formability (easiness of being formed and punched out) of the duplex structure steel. In addition, the duplex structure steel, when aged, does not substantially increase the hardness. Accordingly, with the material contemplated herein, no serious problem on its formability are posed even if it is aged before mechanically formed into desired shapes of the final springs.

(2) Since the spring limit value of the duplex structure steel can be enhanced by aging the material for a short period of time, it is possible to continuously age the material in the form of a strip on the steel maker side, eliminating the burden of expensive batchwise heat treatment on the spring maker side.

(3). Since the process according to the invention is not based on the principle of increase in strength by rolling, it is easy to produce strips of good shape.

(4). Since the strip produced by the process according to the invention has reduced plane anisotropy with respect to the spring characteristics, no limitation are imposed on the direction in which springs are taken from the strip.

It can be said therefore that substantially all the problems associated with the conventional stainless steel strips for spring have now been solved by the high strength stainless steel strip of a duplex structure produced by the process according to the invention.

The steel envisaged herein comprises, as essential ingredients, in addition to Fe, from 10.0 to 20.0% by weight of Cr, from 0.01 to 0.15% by weight of C, and at least one of Ni, Mn and Cu in an amount of from 0.1 to 4.0% by weight.

Cr must be contained in an amount of at least 10.0% to achieve the desired level of corrosion resistance as stainless steels. However, as the Cr content increases, the amounts of austenite formers such as Ni, Mn and Cu required for the eventual formation of martensite to achieve high strength increase on the one hand, and the proof strength of the material is lowered on the other hand. Accordingly, the upper limit for Cr is now set as 20.0%.

C is a strong austenite former and serves not only to increase an amount of eventually formed martensite but also to effectively strengthen both the martensitic and ferritic phased by dissolving therein. It is also an important element for enhancing the spring limit value by aging. For these effects at least 0.01% of C is essential. If C is excessively high, however, in the course of the heat treatment comprising the steps of heating to a temperature range for a two phase of ferrite and austenite and rapid cooling, chromium carbide which is dissolved during the heating step reprecipitates in grain boundaries of ferrite or austenite (martensite after rapidly cooled) during the step of rapid cooling, whereby layers short in Cr are formed near the grain boundaries (the so-called phenomenon of sensitization), leading to marked reduction in the corrosion resistance of the material. For this reason, C should preferably be controlled at a level of not more than 0.15%, although depending upon the particular amounts of other elements including Cr, Ni, Mn and Cu.

Ni, Mn and Cu make it possible to reduce the amount of C needed, serving to avoid the above mentioned sensitization due to C, and are effective austenite formers as a substitute for C for forming a two phase of ferrite and austenite at high temperatures. As the amounts of Ni, Mn and Cu increase, the amount of eventually formed martensite (the amount of austenite formed at high temperatures) increases, thereby enhancing the strength (hardness) of the material. To enjoy these effects, at least 0.1% of Ni, Mn or Cu is required. On the other hand, excessively high amounts of these elements should be avoided, or otherwise the amount of martensite eventually formed increases, often to 100%, rendering the elongation of the material poor. The upper limit for each of Mn, Ni and Cu is now set as 4.0%.

In the steel which can be used herein, alloying elements must be adjusted so that the steel may exhibit a two phase structure of ferrite and austenite at high temperatures. In order to solve the above-discussed problems associated with conventional stainless steels for spring, it is essential to realize the fundamental duplex structure and aging property of the steel for achieving the desired spring characteristics. For this purpose, it is required to control at least C, Cr, Ni, Mn and Cu as prescribed above. So far as the fundamental structure and property of the steel are not hindered, the steel used herein may be incorporated with other elements for various purposes, for example, Mo for further enhancing the corrosion resistance, Y or REM (rare earth metals) for improving the oxidation resistance, and B, V, Al and others for respective purposes, or certain elements may be controlled. The steel which can be used herein may be incorporated with up to 2.50% of Mo, up to 0.20% of Y, up to 0.10% of REM, up to 0.20% of V, up to 0.0050% of B and/or up to 0.20% of Al.

In the heat treatment for forming a duplex structure, a cold rolled strip of the above mentioned composition should be heated to a temperature range for a two-phase of ferrite and austenite. With steels advantageously used herein, the lowest temperature for forming a two-phase of ferrite and austenite is generally within the range of from 600° to 900° C., while the upper temperature for forming a two-phase of ferrite and austenite is generally within the range of from 1200° to 1450° C.

When the steel is heated to a temperature range for a two-phase of ferrite and austenite, an equilibrium amount of an austenite phase is formed within a short period of time. Generally, heating of not longer than 10 minutes is sufficient. This fact makes it possible to continuously heat treat the steel in the form of a strip, and is very advantageous from view points of productivity and manufacturing cost.

The cooling rate in the heat treatment should be sufficient to transform the austenite to martensite. Practically, a cooling rate of from about 1° to 1000° C./sec may be used. After the austenite has been transformed to martensite, the cooling rate is not critical.

In the process according to the invention, the step of continuous aging is very important for a purpose of achieving excellent spring characteristics. The aging is preferably carried out at a temperature from 300° to 650° C. If the aging temperature is substantially lower than 300° C., the spring characteristics will not be satisfactorily improved. On the other hand, if the material is aged at a temperature substantially exceeding 650° C., C which has supersaturated the solid duplex phase at the end of the heat treatment tends to precipitate as chromium carbide in train boundaries and in grains, adversely affecting the strength and spring characteristics of the material, and in particular chromium carbide which has precipitated in grain boundaries invites the so-called sensitization, lowering the corrosion resistance of the material.

As shown in FIG. 2, in the course of the aging, the spring limit value drastically increases within a short period of time, and becomes saturated after 10 minutes. Accordingly, aging of not longer than 10 minutes is sufficient. This short time requirement ensures a possibility of continuous processing, bringing about advantages as is the case with the above-described duplex structure forming heat treatment. The material so heated for a short period of time may be cooled at an arbitrary cooling rate. The cooling rate used in the continuous aging according to the invention does not substantially affect the spring characteristics and other properties of the product.

The heat treatment for forming a duplex structure and the subsequent aging, each can be carried out by passing a cold rolled strip through a continuous heat treatment furnace equipped with a coil unwinding machine and a coil winding machine and having a heating and soaking zone and a cooling zone in the furnace between the coil unwinding and winding machines. Examples of such continuous heat treatment furnace include, for example, continuous bright annealing furnaces and continuous annealing and pickling furnaces for processing stainless steel strips as well as continuous annealing furnaces for processing mild steel strips. Particularly, when no temper rolling step is carried out between the step of heat treatment for forming a duplex structure and the step of aging, the heat treatment and aging of the process according to the invention can be conveniently carried out by passing a cold rolled strip once through a continuous heat treatment line having two stage zones, each adapted to heating and cooling, for example, through a continuous annealing furnace for mild steel strips having a high temperature soaking zone and an overaging zone.

For further enhancing the eventual spring characteristics, it is effective to temper roll the heat treated strip before aging it. In that case, however, a temper rolling reduction of not more than 10% should be used, or otherwise the aged product tends to have a poor elongation and formability on the one hand, and the desirably reduced plane anisotropy with respect to the spring characteristics cannot be achieved.

EXAMPLES

The invention will be illustrated by the following examples.

TABLE 2

| | (% by weight) | | | | | | | | | | |
|---|---|---|---|---|---|---|---|---|---|---|---|
| Steel | C | Si | Mn | P | S | Ni | Cr | N | Cu | Others | Remarks |
| 1 | 0.061 | 0.40 | 0.27 | 0.021 | 0.004 | 0.10 | 11.95 | 0.009 | 0.03 | | Steel composition envisaged herein |
| 2 | 0.050 | 0.42 | 0.24 | 0.017 | 0.005 | 1.06 | 16.25 | 0.010 | 0.02 | | Steel composition envisaged herein |
| 3 | 0.096 | 0.58 | 0.33 | 0.022 | 0.002 | 1.07 | 16.46 | 0.006 | 0.03 | | Steel composition envisaged herein |
| 4 | 0.048 | 1.39 | 1.26 | 0.020 | 0.001 | 0.97 | 16.48 | 0.011 | 0.01 | V:0.11 | Steel composition envisaged herein |
| 5 | 0.011 | 0.46 | 0.33 | 0.022 | 0.001 | 1.91 | 16.45 | 0.008 | 0.03 | B:0.0025 | Steel composition envisaged herein |
| 6 | 0.049 | 0.57 | 0.24 | 0.025 | 0.004 | 3.00 | 16.36 | 0.009 | 0.02 | | Steel composition envisaged herein |
| 7 | 0.111 | 0.39 | 1.98 | 0.023 | 0.002 | 0.03 | 18.20 | 0.011 | 0.01 | REM:0.021, Y:0.027 | Steel composition envisaged herein |
| 8 | 0.073 | 0.32 | 0.32 | 0.020 | 0.006 | 0.18 | 16.36 | 0.032 | 1.61 | | Steel composition envisaged herein |
| 9 | 0.097 | 0.60 | 0.32 | 0.029 | 0.002 | 0.49 | 16.60 | 0.008 | 3.00 | Mo:2.03 | Steel composition envisaged herein |
| 10 | 0.112 | 0.53 | 1.10 | 0.033 | 0.009 | 7.51 | 17.43 | 0.026 | 0.05 | | Steel composition not envisaged herein |
| 11 | 0.050 | 0.52 | 0.82 | 0.027 | 0.007 | 8.55 | 18.03 | 0.033 | 0.16 | | Steel composition not envisaged herein |

From each molten steel of the composition indicated in Table 2, a slab was prepared. Steels No. 1 through No.9 are those envisaged herein. Each slab was made to a hot rolled strip having a thickness of 3.6 mm, annealed in an furnace at a temperature of 780° C. for a soaking time of 6 hours, allowed to cool in the furnace, pickled, cold rolled to a thickness of 1.0 mm, subjected to intermediate annealing at 780° C. for a soaking time of 1 minute, pickled and cold rolled to a strip of 0.3 mm in thickness. The strip was subjected to continuous heat treatment for forming a duplex structure, temper rolled and subjected to continuous aging under conditions indicated in Table 3. Steels No 10 and No, 11 are SUS301 and SUS304, respectively, which are those not envisaged herein. Each slab of Steels No. 10 and No. 11 was made to a hot rolled strip having a thickness of 3.0 mm, annealed at 1100° C. for a soaking time of 1 minute, rapidly cooled, and pickled. Each hot rolled strip was subjected to repeated combinations of cold rolling and annealing (comprising heating and soaking at 1050° C. for 1 minute and rapid cooling) and eventually cold rolled at a temper rolling reduction indicated in Table 3, and optionally subjected to batchwise aging comprising heating and soaking at 400° C. for 60 minutes followed by air cooling as indicated in Table 3.

TABLE 3

| | | Formation of duplex structure *1 | | Temper rolling | Aging | | Hard- | Spring limit value Kb (kgf/mm²) | | |
|---|---|---|---|---|---|---|---|---|---|---|
| Ex. | Steel | Temp. (°C.) | Martensite (vol. %) | reduction (%) | Temp. (°C.) | Time (min) | ness (HV) | LD | TD | Remarks |
| A | | | | | | | | | | |
| 1 | 1 | 1000 | 85 | 0 no rolling | 400 | 1 | 340 | 112 | 117 | |

TABLE 3-continued

| Ex. | Steel | Formation of duplex structure *1 Temp. (°C.) | Martensite (vol. %) | Temper rolling reduction (%) | Aging Temp. (°C.) | Time (min) | Hardness (HV) | Spring limit value Kb (kgf/mm²) LD | TD | Remarks |
|---|---|---|---|---|---|---|---|---|---|---|
| 2 | 2 | 1000 | 40 | 0 no rolling | 500 | 1 | 275 | 65 | 73 | |
| 3 | 3 | 1000 | 40 | 8 | 500 | 1 | 320 | 115 | 123 | |
| 4 | 4 | 950 | 55 | 1 | 600 | 1 | 346 | 82 | 75 | |
| 5 | 4 | 1000 | 35 | 1 | 500 | 1 | 301 | 68 | 65 | |
| 6 | 5 | 950 | 40 | 1 | 350 | 5 | 273 | 117 | 123 | |
| 7 | 6 | 950 | 70 | 0 no rolling | 400 | 5 | 388 | 162 | 156 | |
| 8 | 6 | 950 | 70 | 5 | 400 | 5 | 425 | 176 | 192 | |
| 9 | 7 | 1000 | 35 | 0 no rolling | 500 | 1 | 284 | 63 | 61 | |
| 10 | 8 | 1000 | 50 | 1 | 500 | 1 | 352 | 86 | 90 | |
| 11 | 9 | 950 | 55 | 1 | 500 | 1 | 367 | 83 | 87 | |
| B | | | | | | | | | | |
| 1 | 2 | 780 | 0 | 0 no rolling | 500 | 1 | 151 | 21 | 23 | Single ferritic |
| 2 | 2 | 1000 | 40 | 0 no rolling | — | — | 270 | 32 | 36 | Not aged |
| 3 | 2 | 1000 | 40 | 15 | 500 | 1 | 331 | 120 | 138 | Large rolling reduction |
| 4 | 6 | 950 | 70 | 0 no rolling | — | — | 381 | 47 | 51 | Not aged |
| 5 | 10 | — | — | 15 | 400 | 60 | 324 | 35 | 49 | SUS301-CSP |
| 6 | 10 | — | — | 35 | — | — | 385 | 40 | 65 | SUS301-CSP |
| 7 | 11 | — | — | 40 | — | — | 365 | 48 | 78 | SUS304-CSP |
| 8 | 11 | — | — | 40 | 400 | 60 | 376 | 57 | 82 | SUS304-CSP |

A: Examples according to the invention
B: Comparative Examples
*1: Soaked for 1 min. and cooled at about 20° C./sec. vol. % of martensite was determined by observation of metallic structure.

Each product was tested for the hardness and spring limit value Kb in LD and TD. Results are shown in Table 3. Incidentally, different runs on the same steel were carried out using divided parts of a single coil of that steel.

Table 3 reveals that the duplex structure steels produced by the process according to the invention have a high spring limit value Kb and reduced plain anisotropy with respect to the spring characteristics as reflected by a small difference of Kb between LD and TD. As revealed by comparison of Examples 2 and 3, or Examples 7 and 8, the spring limit value can be further improved if the material is temper rolled before it is aged.

In contrast the product of Comparative Example 1 involving heat treatment at a temperature as low as 780° C. (which heat treatment was nothing but annealing at a temperature for forming a single phase of ferrite), exhibited a single ferritic structure with no martensite and had a low hardness (strength) and a low spring limit value Kb even in the aged condition.

Comparative Examples 2 and 4 are comparable with Examples 2 and 7, respectively. The products of these Comparative Examples wherein no aging was carried out had a spring limit value Kb much lower than that of the products of Examples 2 and 7 according to the invention.

The spring limit value of the product of Comparative Example 3 involving a temper rolling reduction as high as 15%, is high but not satisfactorily isotropic. Furthermore, although not shown in Table 3, when the product of Comparative Example 3 was bent by 180° along the direction of rolling with an inner bend radius of 1.0 mm, occurrence of cracking indicating a poor formability was observed. Such was not the case with all other products.

Comparative Examples 5 to 8 relate to conventional austenitic stainless steels, SUS301-CSP and SUS304-CSP. The spring limit value of the products of these Comparative Examples are not isotropic and the values in themselves are very poor, irrespectively of being aged or not, when compared with the products produced by the process according to the invention.

As described in detail, the process according to the invention is productive of high strength stainless steel strips of a duplex structure having excellent and fairly isotropic spring characteristics. As illustrated in Examples, these strips have a hardness low enough not to hinder punching-out springs therefrom, that is a hardness (HV) of 400 or lower in the cases of not temper rolled materials and a hardness (HV) of 450 or lower in the cases of temper rolled materials on the one hand, and a spring limit value as high as at least 60 kgf/mm². Accordingly, the strips produced by the process according to the invention can be easily mechanically formed into springs of desired shapes, and the so formed springs need not be subjected to heat treatment for developing spring characteristics. Such strips and sheets or plates cut therefrom are novel in the art of stainless steel materials for spring. The invention provides such novel and useful materials to the market, and thus, has made a great contribution to the art. In addition, since the heat treatment and the subsequent aging involved herein can be carried out by continuously passing a strip through a heat treatment furnace or furnaces, the process according to the invention can be carried out with good productivity.

What is claimed is:

1. A process for the production of a high strength stainless steel strip of a duplex structure having an excellent spring limit value, which comprises:

conventional hot rolling and cold rolling steps to provide a cold rolled strip of a stainless steel, said stainless steel further comprising from 10.0 to 20.0% by weight of Cr, from 0.01 to 0.15% by weight of C, up to 1.39% by weight of Si, up to 0.032% by weight of N and at least one of Ni, Mn and Cu in an amount of from 0.1 to 4.0% by weight, the balance being Fe and impurities;

a step of heat treatment for forming a duplex structure in which the cold rolled strip is continuously passed through a continuous heat treatment furnace where it is heated to a temperature range for a two-phase of ferrite and austenite, and thereafter the strip is rapidly cooled to provide a strip of a duplex structure, consisting essentially of ferrite and martensite; and a step of continuous aging the strip for an effective period of time of not longer than 10 minutes in which the strip of the duplex structure is continuously passed through a continuous heat treatment furnace where the strip is heated to a temperature ranging from 300° to 650° C., the aged strip having a hardness (HV) of not higher than 400 and a spring limit value Kb, in both the rolling direction and the direction perpendicular thereto, of at least 60 kgf/mm$^2$.

2. A process for the production of a high strength stainless steel strip of a duplex structure having an excellent spring limit value, which comprises:

conventional hot rolling and cold rolling steps to provide a cold rolled strip of a stainless steel, said stainless steel further comprising from 10.0 to 20.0% by weight of Cr, from 0.01 to 0.15% by weight of C, up to 1.39% by weight of Si, up to 0.032% by weight of N and at least one of Ni, Mn and Cu in an amount of from 0.1 to 4.0% by weight, the balance being Fe and impurities;

a step of heat treatment for forming a duplex structure in which the cold rolled strip is continuously passed through a continuous heat treatment furnace where it is heated to a temperature range for a two-phase of ferrite and austenite, and thereafter the strip is rapidly cooled to provide a strip of a duplex structure, consisting essentially of ferrite and martensite;

a step of temper rolling the strip of the duplex structure at a rolling reduction of an effective amount not more than 10%; and a step of continuous aging the strip for a period of time of not longer than 10 minutes in which the temper rolled strip is continuously passed through a continuous heat treatment furnace where the strip is heated to a temperature ranging from 300° to 650° C., the aged strip having a hardness (HV) of not higher than 450 and a spring limit value Kb, in both the rolling direction and the direction perpendicular thereto, of at least 65 kgf/mm$^2$.

3. The process in accordance with claim 1 wherein said steel comprises from 10.0 to 20.0% by weight of Cr, from 0.01 to 0.15% by weight of C, up to 1.39% by weight of Si, up to 0.032% by weight of N, at least one of Ni, Mn and Cu in an amount of from 0.1 to 4.0% by weight, up to 2.50% by weight of Mo, up to 0.20% by weight of Y, up to 0.10% by weight of rare earth metal, up to 0.20% by weight of V, up to 0.0050% by weight of B and up to 0.20% by weight of Al, the balance being Fe and impurities.

4. The process in accordance with claim 2 wherein said steel comprises from 10.0 to 20.0% by weight of Cr, from 0.01 to 0.15% by weight of C, up to 1.39% by weight of Si, up to 0.032% by weight of N, at least one of Ni, Mn and Cu in an amount of from 0.1 to 0.4% by weight, up to 2.50% by weight of Mo, up to 0.20% by weight of Y, up to 0.10% by weight of rare earth metal, up to 0.20% by weight of V, up to 0.0050% by weight of B and up to 0.20% by weight of Al, the balance being Fe and impurities.

5. The process in accordance with claim 2 wherein said strip of the duplex structure is temper rolled at a rolling reduction of from 1 to 10%.

* * * * *